United States Patent [19]

Jackson

[11] Patent Number: 4,819,405

[45] Date of Patent: Apr. 11, 1989

[54] OPAQUE CLADDING PANEL

[75] Inventor: James R. Jackson, Newburgh, England

[73] Assignee: Pilkington Brothers plc, St. Helens, England

[21] Appl. No.: 66,541

[22] Filed: Jun. 26, 1987

[30] Foreign Application Priority Data

Jul. 4, 1986 [GB] United Kingdom ..... 8616351

[51] Int. Cl.[4] ..... E04C 2/34; E06B 7/12

[52] U.S. Cl. ..... 52/810; 52/171; 52/209; 52/235; 52/304; 52/830

[58] Field of Search ..... 52/209, 171, 304, 788, 52/790, 235, 785, 810, 829, 830

[56] References Cited

U.S. PATENT DOCUMENTS

| | | | |
|---|---|---|---|
| 1,982,351 | 11/1934 | Phillips | 52/304 |
| 2,827,674 | 3/1958 | Hayck | 52/209 |
| 3,319,388 | 5/1967 | Olsen | 52/235 |
| 4,543,756 | 10/1985 | Kaminaga et al. | 52/235 |
| 4,557,088 | 12/1985 | Kaminaga | 52/235 |
| 4,561,228 | 12/1985 | Kaminaga | 52/235 |
| 4,610,115 | 9/1986 | Thompson, Jr. | 52/171 |

FOREIGN PATENT DOCUMENTS

| | | | |
|---|---|---|---|
| 629805 | 10/1961 | Canada | 52/304 |
| 705578 | 3/1965 | Canada | 52/304 |
| 293876 | 9/1916 | Fed. Rep. of Germany . | |
| 158118 | 3/1940 | Fed. Rep. of Germany | 52/209 |
| 1123100 | 2/1962 | Fed. Rep. of Germany . | |
| 2650740 | 5/1977 | Fed. Rep. of Germany | 52/790 |
| 2938762 | 9/1981 | Fed. Rep. of Germany . | |
| 892722 | 3/1962 | United Kingdom . | |
| 1502396 | 3/1978 | United Kingdom . | |
| 1558504 | 1/1980 | United Kingdom . | |

*Primary Examiner*—Michael Safavi

*Attorney, Agent, or Firm*—Burns, Doane, Swecker & Mathis

[57] ABSTRACT

An opaque cladding panel for incorporation in a fully-glazed facade of a building comprises an outer glass sheet which is separated from an opaque backing sheet by a peripheral spacer, there being provided at least one venting aperture to ventilate the interspace between the glass sheet and the opaque backing sheet. The glass sheet is optionally coated on its inner surface with a coating, such as a semi-reflective coating. The provision of the at least one venting aperture ventilates the interspace and thereby reduces or avoids condensation in the interspace which would degrade the coating on the glass sheet.

8 Claims, 1 Drawing Sheet

OPAQUE CLADDING PANEL

BACKGROUND OF THE INVENTION

This invention relates to an opaque cladding panel for incorporation in a fully-glazed facade of a building.

Many modern commercial buildings are constructed with a substantially fully-glazed facade using tinted or semi-reflecting glass. The principal component of the facade is made up of transparent vision panels which are in effect the windows of the building, and opaque cladding panels, referred to as "spandrel panels", are embodied in the facade to mask the structural elements and service conduits of the building.

GB-A-No. 1558504 discloses a composite panel for use as a facade element for cladding wall portions of buildings. The composite panel has an outer transparent glass panel and an inner opaque glass panel parallel to and spaced from the outer panel. The space between the panels is sealed and is filled with a gas other than air which has a thermal conductivity less than that of air. GB-A-No. 1353170 discloses opaque, insulating, hermetically sealed, spandrel glazing units.

DE-PS No. 1123100 describes a prefabricated panel for the outer walls of buildings with an inner insulating panel and an outer cladding panel of material impermeable to vapour. This outer cladding panel may be glass. The inner and outer panels are held together by U shaped clamps on at least the upper and lower edges of the panel.

To avoid build up of moisture in the insulating panel, with consequent loss of insulating properties, and to allow air to pass through the panel to ensure a healthy room atmosphere, the outer panel is inset from the outer panel on its upper and lower edges, an intermediate spacer element in the form of a corrugated sheet is provided between the inner and outer panels and provision is made for the entry of air between or through the clamps.

DE-A-No. 2938762 describes the use of glazing applied to an external masonry wall for heating a building. A glazing unit, preferably a double glazing unit, is mounted on the outer face of the wall one or several centimeters in front of it by, for example, a wooden frame. The horizontal sides of the frame may be provided with closable ventilation slits.

In some buildings the spandrel panels are a good colour match with the vision panels, thus presenting a completely uniform impression to the observer from the outside of the building. In other buildings the spandrel panels contrast with the vision panels, or appear to have a different shade from the vision panels, thus producing a ribbon effect along the facade when viewed externally. The panels are mounted on a framework which usually, although not necessarily, comprises metal transom and mullion members.

In use, the appearance of such spandrel panels incorporating an outer glass sheet tends to deteriorate and become patchy and non-uniform. The deterioration may result from degradation of coatings used in the spandrel product.

It is an object of the present invention to provide a solution to this problem. The present invention accordingly relates to an opaque spandrel plane of simple construction which has an interspace which is ventilated to avoid condensation of water and/or organic vapour in the interspace.

SUMMARY OF THE INVENTION

According to the invention there is provided an opaque cladding panel for incorporation in a fully-glazed facade of a building, comprising an outer glass sheet which is separated from an opaque backing sheet by a peripheral spacer, there being provided at least one venting aperture to ventilate the interspace between the glass sheet and the opaque backing sheet.

Preferably, the at least one venting aperture is in the peripheral spacer.

In a preferred embodiment the peripheral spacer is a spacer frame.

The glass sheet may be tinted, but in modern constructions may have a semi-reflective coating on its inner surface.

Preferably the opaque backing sheet has a darkened surface facing the glass. This backing sheet may be an aluminium sheet which has a blackened surface. For example the aluminium sheet may be coated with black paint, or may have a black anodised surface.

To provide thermal insulation of the building interior from the external environment the opaque backing sheet may be backed by a layer of insulating material.

When mounting the opaque cladding panels in the building facade venting aperture or apertures in the spacer frame are in register with hollow transom or mullion members of the facade, which transom or mullion members are vented to the outside atmosphere.

From this aspect the invention also provides an opaque cladding panel of the invention in combination with a hollow transom or mullion member of a facade which has an aperture which registers with the venting aperture or apertures in the spacer, thereby providing a ventilation path from the outside atmosphere to the interspace in the panel. In the preferred embodiment the hollow transom or mullion member has a venting aperture in its outer face.

BRIEF DESCRIPTION OF THE DRAWINGS

An embodiment of the invention will now be described, by way of example with reference to the accompanying drawings in which:-

DETAILED DESCRIPTION OF THE PREFERRED EMBODIMENTS

Figure 1:
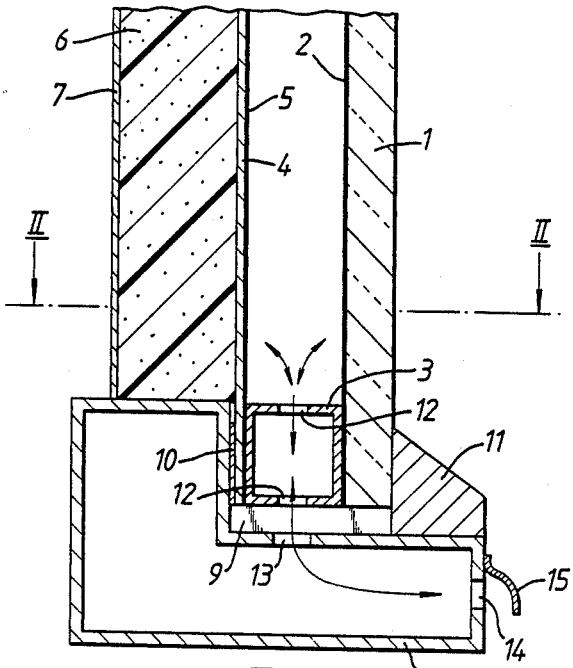
FIG. 1 is a vertical section through an opaque cladding panel according to the invention seated on a hollow transom of a facade.
Figure 2:
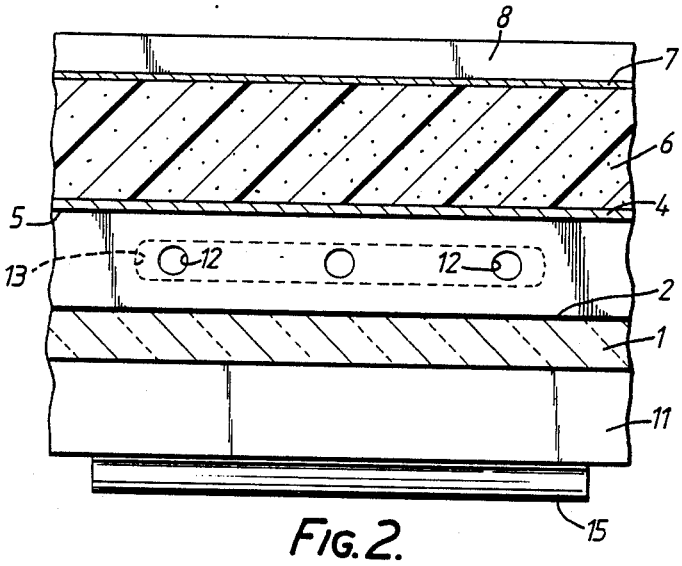
FIG. 2 is a section on line II-II of FIG. 1.

Referring to the drawings an opaque cladding panel or spandrel panel for incorporation in a fully-glazed facade of a building comprises a glass sheet 1 having a coated inner surface 2 so that the appearance of the sheet from the outside matches that of the transparent vision panels of the facade. The glass sheet 1 may be a sheet of float glass 6mm thick having on its inner surface a semi-reflective coating 2 of sputtered metal, which glass is commercially available as toughened SUNCOOL (Trade Mark) Silver 10/23 glass. The glass sheet 1 may be a sheet of float glass having on its inner surface a semi-reflective silicon coating, or may be a sheet of tinted glass. The glass sheet 1 is separated by a spacer frame 3 from an opaque backing sheet 4 which has a darkened surface 5 facing the glass. The spacer frame 3 comprises frame members of rectangular cross-section which are connected together by corner keys, not shown, in conventional manner. Such spacer frames are used for the manufacture of some double glazing units. The combined thickness of the panel comprising the glass sheet 1, the spacer frame 3 and the backing sheet 4 matches that of double glazing units which form the transparent vision panels of the facade. For example a thickness of 24 mm is in use as a standard in such facade construction. The overall dimensions of the opaque cladding panel may be 1600×900 mm.

In the preferred embodiment the backing sheet is an aluminium sheet 1mm thick which has a coating of black paint 5. This gives a uniform matt black surface 5 facing outwardly towards the glass sheet 1 and this matt black backing ensures that the appearance of the opaque panels from the outside does not differ from that of the transparent double glazing panels whose outer glass sheets carry an inner coating of the same as the coating 2. Alternatively the aluminium sheet may have a black anodised surface.

The backing sheet 4 is itself backed by a thick layer 6 of insulating material, for example foamed plastics or fibreglass board insulation material, which itself has an impermeable facing layer 7, for example of aluminium foil.

The panels of the facade are mounted in a frame of hollow transoms and mullions and a hollow transom 8 of stepped shape is illustrated in FIG. 1. Each panel is seated on setting blocks 9 which are spaced along the transom 8 without obstructing ventilation apertures in the transom. The depth of the step in the transom extending from the outside of the building is sufficient to accomodate a sealing gasket 10 between the panel and the transom, and conventional fixing members, for example a retaining bead or gasket 11.

Venting apertures 12 are drilled through the spacer frame and register with an aperture 13 in the step 8 of the transom. In the embodiment illustrated three venting holes 12 drilled through the spacer frame 3 register with a venting slot 13 in the step of the transom 8.

The transom 8 has a further venting slot 14 in its outer face which slot is protected by a weather shield 15 which is welded to the front face of the transom.

There is thus provided, as indicated by the arrows in FIG. 1, a ventilation path from the outside atmosphere to the interspace between the glass sheet 1 and the backing sheet 4 of the opaque cladding panel. This ensures that the climate in the interspace of the cladding panel is in equilibrium with the outside atmosphere and the ventilation ensures that there is no condensation of water and/or organic vapour on the coated inner surface 2 of the glass sheet. This controls or at least alleviates the problem, which is encountered in the prior art, of deterioration of the coating used in the spandrel product which is caused by such condensation.

The backing sheet 4 in the embodiment illustrated, is preferably a thin aluminium sheet, but could be a plastics sheet or a sheet of other impermeable material, and acts as a vapour barrier so that any volatiles which find their way towards the opaque cladding panels condense on the inward surface of the backing sheet 4 and cannot reach the interspace between that backing sheet and the outer glass sheet. The insulating layer 6 with its facing 7 provides further safeguard limiting the possibility of volatiles reaching the members of the cladding panel. In this way the interspace between the glass sheet and its backing sheet 4 is sealed from the inside of the building and fully ventilated from the external atmosphere so that condensation on the inner surface of the glass sheet is prevented, as is distortion of the glass sheet since there is pressure equalisation on both sides of that sheet.

The mullions of the facade may also be hollow members with a stepped shape similar to the transoms and providing ventilation paths through to holes in the uprights of the spacer frame of the opaque cladding panel in the same way as illustrated.

The invention thus provides at reduced cost, a lightweight opaque cladding panel for incorporation in a fully-glazed facade of a building, in particular in conjunction with double glazed vision panels, which avoids any possibility of distortion of the outer glass sheets of the cladding panels due to changes in atmospheric pressure.

I claim:

1. A composite spandrel panel unit for incorporation in a fully-glazed facade of a building, the panel unit comprising in combination:

an outer glass sheet including a coating on the inner surface thereof, said glass sheet defining a surface area;

an opaque backing sheet superimposed relative to substantially all of said area of said glass sheet, the backing sheet comprising an aluminum sheet which has a blackened surface immediately facing said coating on said glass sheet; and a peripheral spacer separating the opaque sheet and said glass sheet to define an interspace therebetween, wherein there is at least one venting aperture in said peripheral spacer to ventilate said interspace to prevent deterioration of the appearance of said spandrel panel and said coating due to condensation of water and organic vapor thereon, and to equalize the pressure on both sides of said glass sheet to prevent distortion thereof.

2. A panel unit according to claim 1, wherein the peripheral spacer is a spacer frame.

3. A panel unit according to claim 1, wherein the glass sheet has a semi-reflective coating on said inner surface.

4. A panel unit according to claim 1, wherein the aluminum sheet is coated with black paint.

5. A panel unit according to claim 1, wherein the opaque backing sheet is backed by a layer of insulating material.

6. An assembly of a composite spandrel panel unit for incorporation in a fully-glazed facade of a building and a hollow transom or mullion member of the facade, the panel unit comprising in combination:

an outer glass sheet including a coating on an inner surface thereof, said glass sheet defining a surface area;

an opaque backing sheet superimposed relative to substantially all of said area of said glass sheet, the backing sheet comprising an aluminum sheet which has a blackened surface immediately facing said coating on said glass sheet; and a peripheral spacer separating the opaque sheet and said glass sheet to define an interspace therebetween, wherein there is at least one venting aperture in said peripheral spacer to ventilate said interspace to prevent deterioration of the appearance of said spandrel panel and said coating due to condensation of water and organic vapor thereon, and to equalize the pressure on both sides of said glass sheet to prevent distortion thereof; and the transom or mullion member having an aperture which registers with the venting aperture in the spacer, thereby providing a ventilation path from an atmosphere outside the panel unit to the interspace in the panel unit.

7. An assembly according to claim 6, wherein the hollow transom or mullion member has a venting aperture in an outer face of the hollow transom or mullion member.

8. An assembly according to claim 6, wherein said aluminum sheet is coated with black paint.

* * * * *